US010124600B2

(12) United States Patent
Uematsu

(10) Patent No.: US 10,124,600 B2
(45) Date of Patent: Nov. 13, 2018

(54) PRINTING DEVICE, PRINTING METHOD, AND NONVOLATILE COMPUTER-READABLE RECORDING MEDIUM

(71) Applicant: CASIO COMPUTER CO., LTD., Shibuya-ku, Tokyo (JP)

(72) Inventor: Kenji Uematsu, Hanno (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 15/716,117

(22) Filed: Sep. 26, 2017

(65) Prior Publication Data

US 2018/0086101 A1 Mar. 29, 2018

(30) Foreign Application Priority Data

Sep. 27, 2016 (JP) ..... 2016-187925
Jul. 4, 2017 (JP) ..... 2017-131099

(51) Int. Cl.

| | |
|---|---|
| ***B41J 2/36*** | (2006.01) |
| ***B41J 2/355*** | (2006.01) |
| ***B41J 2/365*** | (2006.01) |
| ***B41J 2/325*** | (2006.01) |

(52) U.S. Cl.

CPC ..... *B41J 2/3551* (2013.01); *B41J 2/325* (2013.01); *B41J 2/36* (2013.01); *B41J 2/365* (2013.01)

(58) Field of Classification Search

CPC ... B41J 3/4075; B41J 2/325; B41J 2/32; B41J 2/36; B41J 2/365; B41J 2/375; B41M 5/0052

See application file for complete search history.

(56) References Cited

FOREIGN PATENT DOCUMENTS

| | | | | |
|---|---|---|---|---|
| JP | 5-84975 | * | 4/1993 | ..... B41J 2/485 |
| JP | 06055760 | A | 1/1994 | |
| JP | 07251520 | A | 10/1995 | |
| JP | 08244298 | A | 9/1996 | |
| JP | 09277579 | A | 10/1997 | |
| JP | 11235837 | A | 8/1999 | |
| JP | 2005169641 | A | 6/2005 | |
| JP | 2011062896 | A | 3/2011 | |

OTHER PUBLICATIONS

Japanese Office Action (and English language translation thereof) dated Jun. 12, 2018 issued in counterpart Japanese Application No. 2017-131099.

* cited by examiner

*Primary Examiner* — Huan Tran
(74) *Attorney, Agent, or Firm* — Holtz, Holtz & Volek PC

(57) ABSTRACT

A printing device includes a thermal head and a head controller. The head controller acquires a number of heater elements to energize based on the line print data, and determines an energization time of one or more heater elements corresponding to the line print data according to a result of comparison between the number of heater elements to energize and a first threshold, wherein in a case where a width of an ink ribbon heated by the energization is equal to or wider than a second threshold, the first threshold being set to be a value that is greater than a value that is set for the first threshold when the width of the ink ribbon heated by the energization is narrower than the second threshold.

14 Claims, 9 Drawing Sheets

FIG. 9

DENSITY COEFFICIENTS TABLE T1

| DENSITY COEFFICIENT [%] | | DENSITY LEVEL | | | | |
|---|---|---|---|---|---|---|
| | | 1 | 2 | 3 | 4 | 5 |
| INK RIBBON WIDTH | 6mm | 80 | 90 | 100 | 110 | 120 |
| | 18mm | 90 | 95 | 100 | 105 | 110 |

FIG. 10

THRESHOLDS TABLE T2 REGARDING THE NUMBER OF PRINT DOTS IN PRIMARY ENERGIZATION

| INK RIBBON WIDTH | TOTAL NUMBER OF DOTS | THRESHOLD |
|---|---|---|
| 6mm | 96 | 67 |
| 18mm | 288 | 230 |

FIG. 11

THRESHOLDS TABLE T3 REGARDING THE NUMBER OF PRINT DOTS IN HISTORICAL ENERGIZATION

| INK RIBBON WIDTH | TOTAL NUMBER OF DOTS | THRESHOLD |
|---|---|---|
| 6mm | 96 | 58 |
| 18mm | 288 | 201 |

FIG. 12

FIRST PRIMARY ENERGIZATION TIME ADJUSTMENT TABLE T4

| FIRST ADJUSTMENT COEFFICIENT OF PRIMARY ENERGIZATION TIME [%] | | DENSITY LEVEL | | | | |
|---|---|---|---|---|---|---|
| | | 1 | 2 | 3 | 4 | 5 |
| INK RIBBON WIDTH | 6mm | 100 | 100 | 95 | 90 | 85 |
| | 18mm | 100 | 100 | 96 | 92 | 88 |

FIG. 13

FIRST HISTORICAL ENERGIZATION TIME ADJUSTMENT TABLE T5

| FIRST ADJUSTMENT COEFFICIENT OF HISTORICAL ENERGIZATION TIME [%] | | DENSITY LEVEL | | | | |
|---|---|---|---|---|---|---|
| | | 1 | 2 | 3 | 4 | 5 |
| INK RIBBON WIDTH | 6mm | 93 | 90 | 85 | 80 | 75 |
| | 18mm | 95 | 92 | 88 | 82 | 80 |

FIG. 14

SECOND PRIMARY ENERGIZATION TIME ADJUSTMENT TABLE T6

| SECOND ADJUSTMENT COEFFICIENT OF PRIMARY ENERGIZATION TIME [%] | | DENSITY LEVEL | | | | |
|---|---|---|---|---|---|---|
| | | 1 | 2 | 3 | 4 | 5 |
| INK RIBBON WIDTH | 6mm | 95 | 90 | 85 | 80 | 75 |
| | 18mm | 100 | 95 | 90 | 85 | 80 |

FIG. 15

SECOND HISTORICAL ENERGIZATION TIME ADJUSTMENT TABLE T7

| SECOND ADJUSTMENT COEFFICIENT OF HISTORICAL ENERGIZATION TIME [%] | | DENSITY LEVEL | | | | |
|---|---|---|---|---|---|---|
| | | 1 | 2 | 3 | 4 | 5 |
| INK RIBBON WIDTH | 6mm | 85 | 83 | 80 | 75 | 70 |
| | 18mm | 90 | 88 | 85 | 80 | 75 |

FIG. 16

THRESHOLDS TABLE T8 REGARDING THE NUMBER OF PRINT DOTS IN PRIMARY ENERGIZATION (INK RIBBON WIDTH 6 mm)

| TEMPERATURE [°C] | THRESHOLD |
|---|---|
| 0 | 57 |
| 1 | 57 |
| 2 | 57 |
| 3 | 57 |
| 4 | 57 |
| 5 | 58 |
| 6 | 58 |
| 7 | 58 |
| 8 | 58 |
| 9 | 58 |
| 10 | 58 |
| 11 | 59 |
| ⋮ | ⋮ |
| 60 | 85 |
| 61 | 86 |
| 62 | 86 |
| 63 | 86 |
| 64 | 86 |
| 65 | 86 |
| 66 | 86 |
| 67 | 86 |
| 68 | 86 |
| 69 | 86 |
| 70 | 86 |

FIG. 17

FIRST PRIMARY ENERGIZATION TIME ADJUSTMENT TABLE T9
(INK RIBBON WIDTH 6 mm, DENSITY LEVEL 3)

| TEMPERATURE [°C] | FIRST DENSITY COEFFICIENT [%] |
|---|---|
| 0 | 95 |
| 1 | 95 |
| 2 | 95 |
| 3 | 95 |
| 4 | 95 |
| 5 | 95 |
| 6 | 95 |
| 7 | 95 |
| 8 | 95 |
| 9 | 95 |
| 10 | 95 |
| 11 | 96 |
| ⋮ | ⋮ |
| 60 | 100 |
| 61 | 100 |
| 62 | 100 |
| 63 | 100 |
| 64 | 100 |
| 65 | 100 |
| 66 | 100 |
| 67 | 100 |
| 68 | 100 |
| 69 | 100 |
| 70 | 100 |

PRINTING DEVICE, PRINTING METHOD, AND NONVOLATILE COMPUTER-READABLE RECORDING MEDIUM

CROSS-REFERENCE TO RELATED APPLICATION

This application claims the benefit of Japanese Patent Application No. 2016-187925, filed on Sep. 27, 2016, and Japanese Patent Application No. 2017-131099, filed on Jul. 4, 2017, of which the entirety of the disclosures is incorporated by reference herein.

FIELD

This application relates generally a printing device, a printing method executed by the printing device, and a nonvolatile computer-readable recording medium on which a program is stored.

BACKGROUND

In the prior art, printing devices are known in which ink applied on an ink ribbon is transferred to a printing medium for printing by controlling energization of heater elements provided to a thermal head. Such a printing device is described in, for example, Unexamined Japanese Patent Application Kokai Publication No. 2011-062896.

In a thermal transfer printing device as described above, if an excessively high energy is applied to the ink ribbon, the ink ribbon may be damaged and consequently the print quality may be deteriorated. Particularly, when a phenomenon called broken ribbon in which an ink ribbon melts and breaks occurs, the printing itself stops.

SUMMARY

The printing device according to the present disclosure is a printing device, comprising:

a thermal head comprising heater elements arrayed into a line along an array direction intersecting a conveying direction of a printing medium; and a head controller that causes the thermal head to print on the printing medium by energizing the heater elements based on line print data into which print data is divided along the array direction, wherein the head controller acquires a number of heater elements to energize based on the line print data, and determines an energization time of one or more heater elements corresponding to the line print data according to a result of comparison between the number of heater elements to energize and a first threshold, wherein, in a case where a width of an ink ribbon heated by the energization is equal to or wider than a second threshold, the first threshold being set to be a value that is greater than a value that is set for the first threshold when the width of the ink ribbon heated by the energization is narrower than the second threshold.

The printing method according to the present disclosure is a printing method executed by a printing device, wherein the printing device comprises:

a thermal head comprising heater elements arrayed into a line along an array direction intersecting a conveying direction of a printing medium; and a head controller that causes the thermal head to print on the printing medium by energizing the heater elements based on line print data into which print data is divided along the array direction, and the printing method includes the following:

acquiring a number of heater elements to energize based on the line print data; and determining an energization time of one or more heater elements corresponding to the line print data according to a result of comparison between the number of heater elements to energize and a first threshold;

wherein, in a case where a width of an ink ribbon heated by the energization is equal to or wider than a second threshold, the first threshold being set to be a value that is greater than a value that is set for the first threshold when the width of the ink ribbon heated by the energization is narrower than the second threshold.

The printing method according to the present disclosure is a printing method executed by a printing device, wherein the printing device comprises:

a thermal head comprising heater elements arrayed into a line along an array direction intersecting a conveying direction of a printing medium; and a head controller that causes the thermal head to print on the printing medium by energizing the heater elements based on line print data into which print data is divided along the array direction, the printing method includes the following:

acquiring a temperature of the thermal head; and determining an energization time of one or more heater elements corresponding to the line print data according to a result of comparison between the acquired temperature of the thermal head and a threshold;

wherein, in a case where a width of an ink ribbon heated by the energization is equal to or wider than a second threshold, the third threshold being set to be a value that is greater than a value that is set for the first threshold when the width of the ink ribbon heated by the energization is narrower than the second threshold.

The printing method according to the present disclosure is a printing method executed by a printing device, wherein the printing device comprises:

a thermal head comprising heater elements arrayed into a line along an array direction intersecting a conveying direction of a printing medium; and a head controller that causes the thermal head to print on the printing medium by energizing the heater elements based on line print data into which print data is divided along the array direction, the printing method includes the following:

energizing one or more heater elements corresponding to the line print data for a shorter energization time in a case where a state acquired before printing on the printing medium satisfies a first set condition than in a case where the acquired state does not satisfy the first set condition.

The nonvolatile computer-readable recording medium according to the present disclosure is a nonvolatile computer-readable recording medium on which a program is stored, the program causing a head controller of a printing device to execute processing, wherein the printing device comprises:

a thermal head comprising heater elements arrayed into a line along an array direction intersecting a conveying direction of a printing medium; and a head controller that causes the thermal head to print on the printing medium by energizing the heater elements based on line print data into which print data is divided along the array direction, and the processing includes the following:

acquiring a number of heater elements to energize based on the line print data, and determining an energization time of one or more heater elements corresponding to the line print data according to a result of comparison between the acquired number of heater elements and a first threshold, wherein, in a case where a width of an ink ribbon heated by the energization is equal to or wider than a second threshold, the first threshold being set to be a value that is greater than a value that is set for the first threshold when the width of the ink ribbon heated by the energization is narrower than the second threshold.

BRIEF DESCRIPTION OF THE DRAWINGS

A more complete understanding of this application can be obtained when the following detailed description is considered in conjunction with the following drawings, in which:

FIG. 9 is a chart showing an example of the density coefficients table according to Embodiment 1 of the present disclosure;

FIG. 10 is a chart showing an example of the thresholds table regarding the number of print dots in primary energization according to Embodiment 1 of the present disclosure;

FIG. 11 is a chart showing an example of the thresholds table regarding the number of print dots in historical energization according to Embodiment 1 of the present disclosure;

FIG. 12 is a chart showing an example of the first primary energization time adjustment table according to Embodiment 1 of the present disclosure;

FIG. 13 is a chart showing an example of the first historical energization time adjustment table according to Embodiment 1 of the present disclosure;

FIG. 14 is a chart showing an example of the second primary energization time adjustment table according to a modified embodiment of Embodiment 1 of the present disclosure;

FIG. 15 is a chart showing an example of the second historical energization time adjustment table according to the modified embodiment of Embodiment 1 of the present disclosure;

FIG. 16 is a chart showing another example of the thresholds table regarding the number of print dots in primary energization according to Embodiment 1 of the present disclosure; and FIG. 17 is a chart showing another example of the first primary energization time adjustment table according to Embodiment 1 of the present disclosure.

DETAILED DESCRIPTION

Embodiment 1

Figure 1:
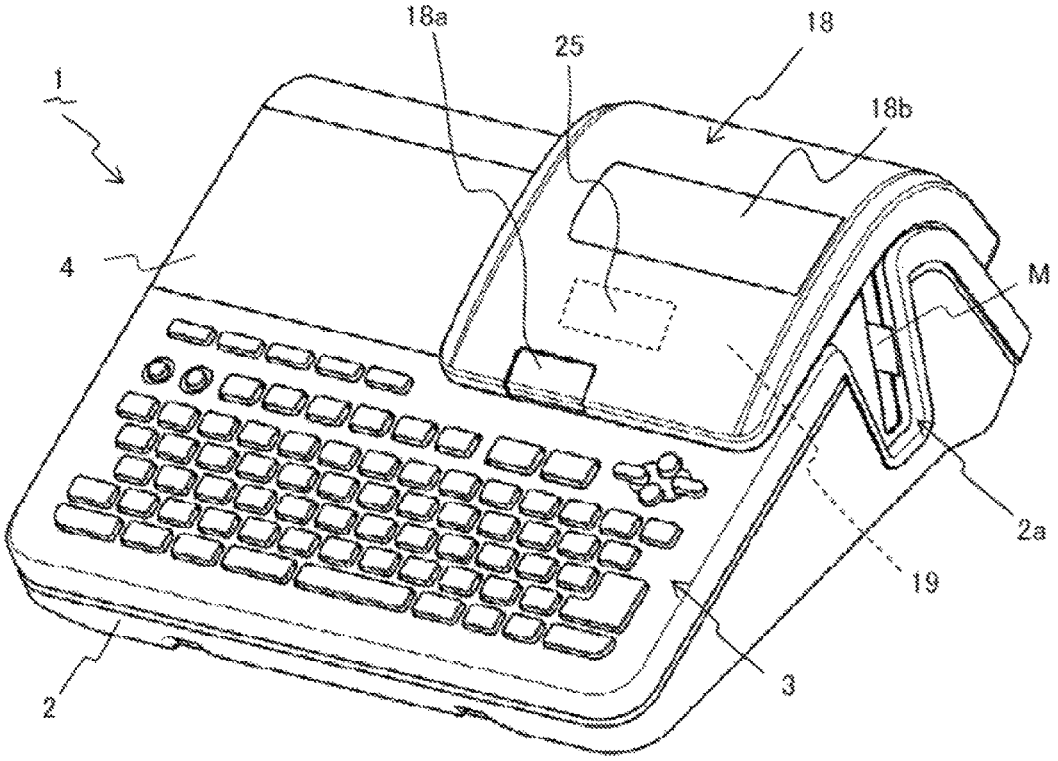
FIG. 1 is a perspective view of the printing device according to Embodiment 1 of the present disclosure.

FIG. 1 is a perspective view of a printing device 1 according to Embodiment 1 of the present disclosure. The printing device 1 is a printing device comprising a thermal head printing on a printing medium and, for example, a label printer printing on an elongated printing medium M in the single path system. The printing medium M is, for example, a tape member having a base having an adhesive layer and a releasable paper attached to the base in a releasable manner to cover the adhesive layer. However, the printing medium M may be a tape member with no releasable paper.

The printing device 1 comprises, as shown in FIG. 1, a device enclosure 2, an input device 3, a display 4, an open/close cover 18, and a cassette housing 19. The input device 3, the display 4, and the open/close cover 18 are disposed on the top surface of the device enclosure 2. Moreover, although not shown, the device enclosure 2 is provided with a power supply cord connection terminal, an external device connection terminal, a storage medium insertion opening, and the like.

The input device 3 comprises various keys such as input keys, an arrow key, a conversion key, and an enter key. The display 4 is, for example, a liquid crystal display panel and displays characters and the like corresponding to input from the input device 3, a selection menu for various settings, messages regarding various kinds of processing, and the like. Moreover, the display 4 displays, during printing, contents such as characters and/or graphics ordered to print on the printing medium M (hereafter, the print content). Furthermore, the display 4 may display the progress of the printing. Here, the display 4 may be provided with a touch panel unit and in such a case, the display 4 functions as a part of the input device 3.

The open/close cover 18 is disposed at the top of the cassette housing 19 in an openable/closable manner. The open/close cover 18 is opened as a button 18*a* is pressed down. The open/close cover 18 has a window 18*b* formed so that whether a tape cassette 30 (see FIG. 2) is housed in the cassette housing 19 can be checked visually even when the open/close cover 18 is closed. A reader 25 is provided on the back of the open/close cover 18 for reading an identification tag 38 (see FIG. 2) attached to the tape cassette 30. The reader 25 is, for example, a radio frequency identifier (RFID) reader. The reader 25 reads an identifier (identification information) from the identification tag 38 to identify the tape cassette 30 and then the material and/or color of the printing medium M and the material and/or color of an ink ribbon R housed in the tape cassette 30, and outputs a sensor signal presenting the identifier. Moreover, a discharge slot 2*a* is formed on a side of the device enclosure 2. The printing medium M printed within the printing device 1 is discharged through the discharge slot 2*a* to outside the device.

Figure 2:
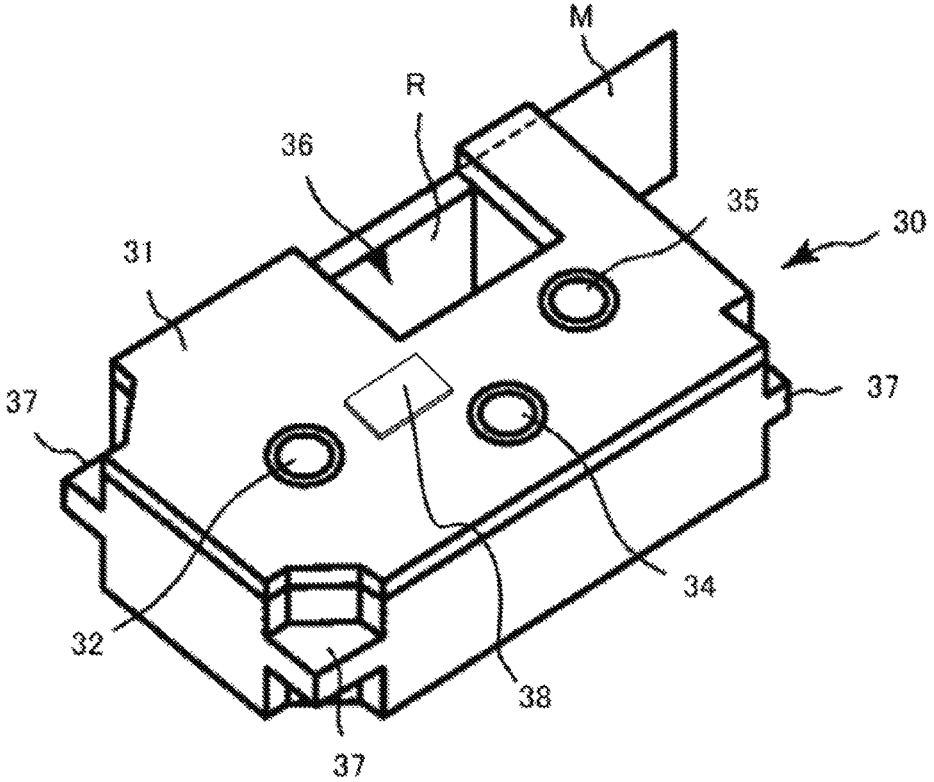
FIG. 2 is a perspective view of a tape cassette to be housed in the printing device according to Embodiment 1 of the present disclosure.
Figure 3:
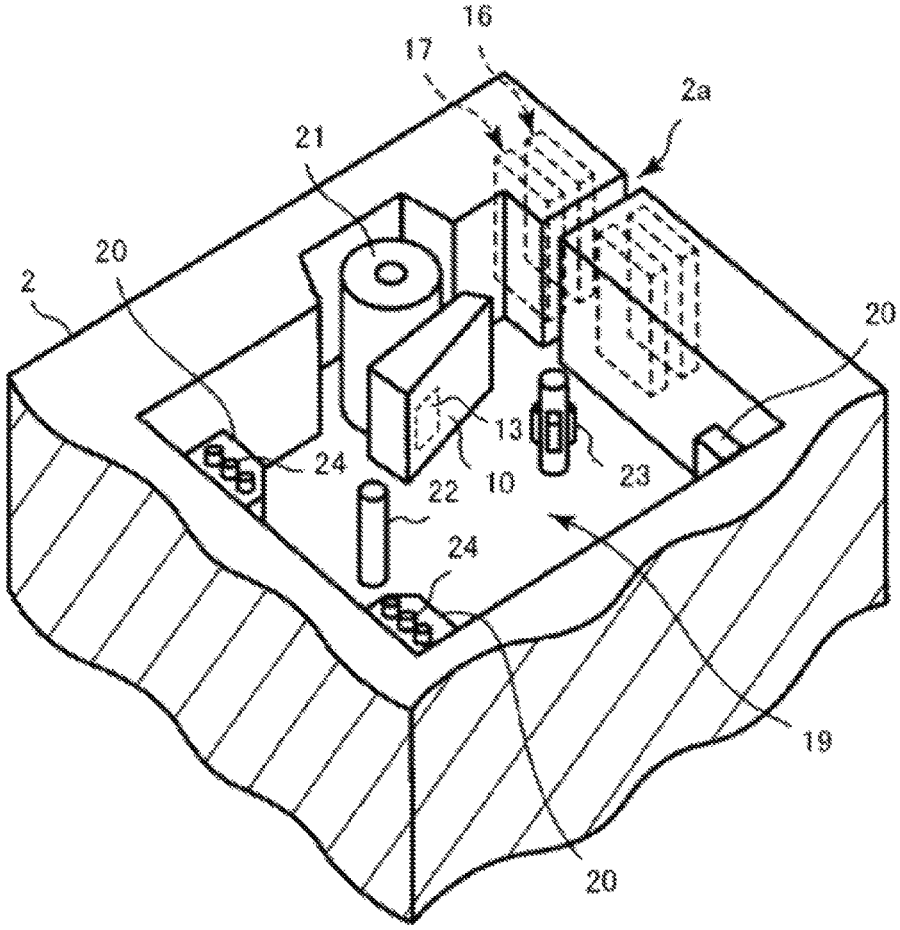
FIG. 3 is a perspective view of the cassette housing of the printing device according to Embodiment 1 of the present disclosure.
Figure 4:
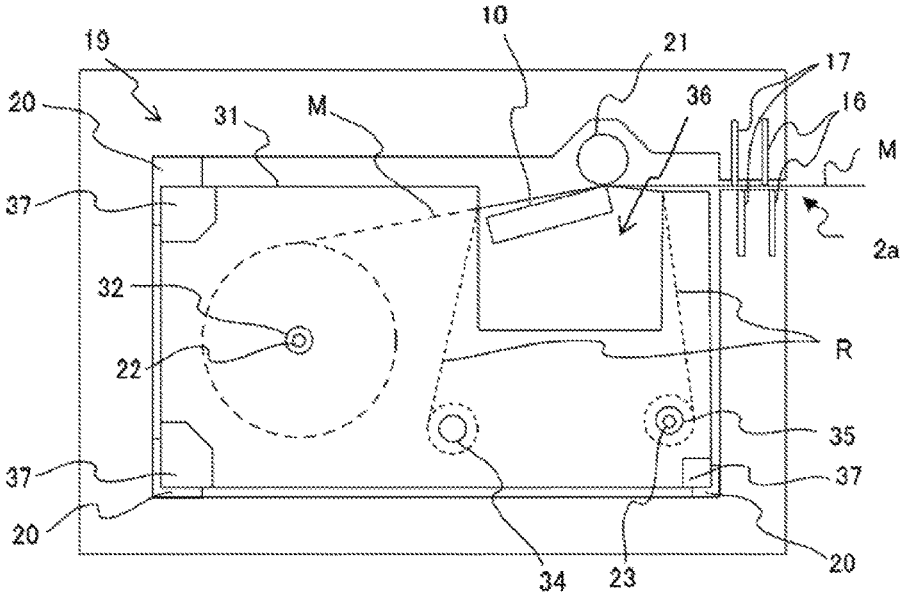
FIG. 4 is a cross-sectional view of the printing device according to Embodiment 1 of the present disclosure.

FIG. 2 is a perspective view of the tape cassette 30 to be housed in the printing device 1. FIG. 3 is a perspective view of the cassette housing 19 of the printing device 1. FIG. 4 is a perspective view of the printing device 1. The tape cassette 30 shown in FIG. 2 is detachably housed in the cassette housing 19 shown in FIG. 3. FIG. 4 shows the state in which the tape cassette 30 is housed in the cassette housing 19.

The tape cassette 30 has, as shown in FIG. 2, a cassette case 31 housing the printing medium M and the ink ribbon R. A thermal head inserter 36 and engagers 37 are formed in the cassette case 31. The identification tag 38 is attached to a surface of the cassette case 31. The identification tag 38 is, for example, an RFID tag and has an identifier recorded for identifying the tape cassette 30 (then, the ink ribbon R housed in the tape cassette 30). Furthermore, the cassette case 31 is provided with a tape core 32, an ink ribbon feed core 34, and an ink ribbon roll-up core 35. The printing medium M is wound around the tape core 32 into a roll within the cassette case 31. Moreover, the thermal transfer ink ribbon R is wound around the ink ribbon feed core 34 into a roll within the cassette case 31 with the leading end wound around the ink ribbon roll-up core 35.

The cassette housing 19 of the device enclosure 2 is provided with cassette receivers 20 for supporting the tape cassette 30 at a given position as shown in FIG. 3. Moreover, the cassette receivers 20 are provided with tape width detection switches 24 for detecting the width of a tape (the printing medium M) housed in the tape cassette 30. The tape width detection switches 24 are a detector detecting the width of the printing medium M and the width of the ink ribbon R that are housed in the tape cassette 30 based on the shape of the tape cassette 30 (an irregular shape provided to the tape cassette 30). The tape width detector switches 24 output a sensor signal presenting the detected width of the printing medium M and the ink ribbon R.

The cassette housing 19 is further provided with a thermal head 10 printing on the printing medium M, a platen roller 21 that is a conveyer conveying the printing medium M, a tape core engaging shaft 22, and an ink ribbon roll-up drive shaft 23. The thermal head 10 has heater elements arrayed into a line and energizes the heater elements based on print data to heat the ink ribbon R and print on the printing medium M. Furthermore, a thermistor 13 is embedded in the thermal head 10. The thermistor 13 is a temperature measurer measuring the temperature of the thermal head 10 and outputs a sensor signal presenting the measured temperature.

With the tape cassette 30 being housed in the cassette housing 19, as shown in FIG. 4, the engagers 37 provided to the cassette case 31 are supported by the cassette receivers 20 provided to the cassette housing 19. Then, the thermal head 10 is inserted into the thermal head inserter 36 formed in the cassette case 31. Moreover, the tape core 32 of the tape cassette 30 engages with the tape core engaging shaft 22. Furthermore, the ink ribbon roll-up core 35 engages with the ink ribbon roll-up drive shaft 23.

As a print order is entered into the printing device 1, the printing medium M is dispensed from the tape core 32 by rotation of the platen roller 21. At this point, the ink ribbon roll-up drive shaft 23 rotates in sync with the platen roller 21, whereby the ink ribbon R is dispensed from the ink ribbon feed core 34 along with the printing medium M. As a result, the printing medium M and the ink ribbon R are conveyed in an overlapped state. Then, while passing between the thermal head 10 and the platen roller 21, the ink ribbon R is heated by the thermal head 10, whereby ink is transferred to the printing medium M for printing.

The used ink ribbon R after passing between the thermal head 10 and the platen roller 21 is rolled up by the ink ribbon roll-up core 35. On the other hand, the printed printing medium M after passing between the thermal head 10 and the platen roller 21 is cut by a half-cut mechanism 16 and a full-cut mechanism 17 and discharged from the discharge slot 2*a*.

Figure 5:
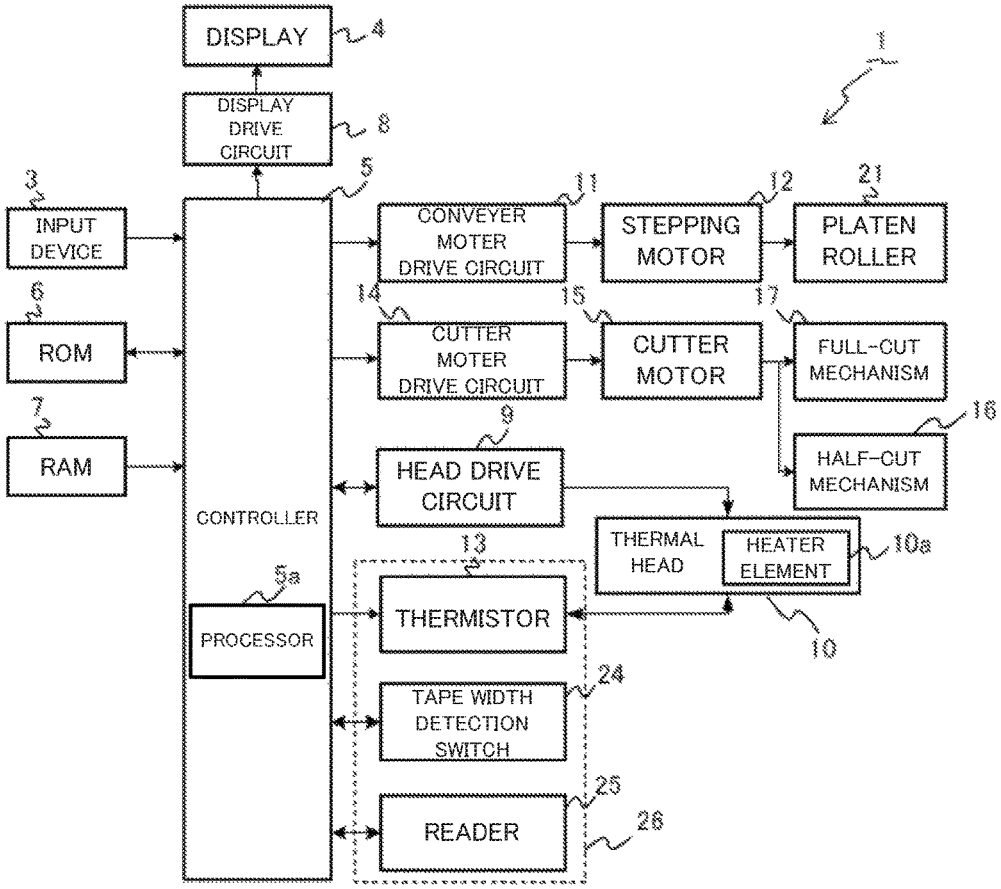
FIG. 5 is a control block diagram of the printing device according to Embodiment 1 of the present disclosure.

FIG. 5 is a control block diagram of the printing device 1. The printing device 1 comprises, in addition to the input device 3, the display 4, the thermal head 10, the thermistor 13, the half-cut mechanism 16, the full-cut mechanism 17, the platen roller 21, the tape width detection switches 24, and the reader 25, a controller 5, a read only memory (ROM) 6, a random access memory (RAM) 7, a display drive circuit 8, a head drive circuit 9, a conveyer motor drive circuit 11, a stepping motor 12, a cutter motor drive circuit 14, and a cutter motor 15. Here, the controller 5, the ROM 6, and the RAM 7 cooperate to function as the computer of the printing device 1.

The controller 5 includes a processor 5*a* such as a central processing unit (CPU). The controller 5 loads on the RAM 7 and executes programs stored in the ROM 6 to control the operations of the parts of the printing device 1. The controller 5 functions as, for example, a head controller controlling energization of heater elements 10*a* of the thermal head 10 via the head drive circuit 9, a conveyance controller controlling the platen roller 21, and a cut controller controlling the cut mechanisms.

The ROM 6 stores a print program for printing on the printing medium M and various data necessary for executing the print program (for example, fonts and the like). Furthermore, the ROM 6 saves various tables described later (a density coefficients table, thresholds tables, and energization time adjustment tables). The ROM 6 also functions as a storage medium storing programs readable by the controller 5.

The RAM 7 functions an input data memory storing information regarding printing (hereafter termed the printing information). Moreover, the RAM 7 also functions as a print data memory storing data generated based on the printing information and presenting a pattern of print contents to be formed on the printing medium (hereafter termed the print data). Furthermore, the RAM 7 also functions as a display data memory storing display data generated based on the printing information.

The display drive circuit 8 controls the display 4 based on the display data stored in the RAM 7. The display 4 may display, for example, the print contents in a manner making the progress of the printing recognizable under the control of the display drive circuit 8.

The head drive circuit 9 energizes the heater elements 10*a* based on the print data during a time period in which a strobe signal is ON (hereafter termed the energization time period). The thermal head 10 is a print head having the heater elements 10*a* arrayed in the main scanning direction. As the head drive circuit 9 selectively energizes the heater elements 10*a* according to the print data during the energization time period of a strobe signal transmitted by the controller 5, the thermal head 10 heats the ink ribbon R with the heater elements 10*a* to print on the printing medium M by thermal transfer line by line.

The conveyer motor drive circuit 11 drives the stepping motor 12. The stepping motor 12 drives the platen roller 21. The platen roller 21 is a conveyer rotating by the motive power of the stepping motor 12 and conveying the printing medium M in the longitudinal direction of the printing medium M (the sub-scanning direction).

The cutter motor drive circuit 14 drives the cutter motor 15. The half-cut mechanism 16 and the full-cut mechanism 17 operate by the motive force of the cutter motor 15. The half-cut mechanism 16 half-cuts the printing medium M.

The full-cut mechanism 17 full-cuts the printing medium M. The full-cut is an operation to cut the base of the printing medium M together with the releasable pater along the width direction. The half-cut is an operation to cut only the base along the width direction.

Here, the thermistor 13 that is the temperature measurer measuring the temperature of the thermal head 10, the tape width detection switches 24 that are the width detector detecting the width of the ink ribbon R, and the reader 25 identifying the ink ribbon R constitute a sensor 26 of the printing device 1. Here, the sensor 26 can include any configuration acquiring information with which the printing environment of the printing device 1 is identified. Therefore, the sensor 26 may include other configurations in addition to the above-described configuration.

Figure 6:
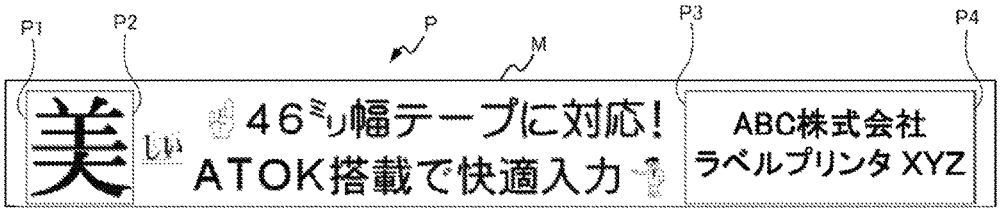
FIG. 6 is an illustration showing an exemplary print pattern to be printed on a printing medium by the printing device according to Embodiment 1 of the present disclosure.

In the printing device 1 employing the thermal transfer method, as described above, if an excessively high energy is applied to the ink ribbon R, the ink ribbon R may be damaged and consequently the print quality may be deteriorated. For example, in printing a print pattern P shown in FIG. 6 on the printing medium M, the ink ribbon R is presumably likely to be damaged while printing a line pattern P1, a line pattern P2, a line pattern P3, and a line pattern P4 for which many of the heater elements 10*a* simultaneously generate heat. However, whether the ink ribbon R is damaged is not determined only by the print data and depends on the printing environment of the printing device 1. This is because the energy applied to the ink ribbon R and the energy the ink ribbon R can accept vary depending on the printing environment. Here, the printing device 1 recognizes the printing environment based on a sensor signal from the sensor 26.

On the basis of the above matters, in the printing device 1, the controller 5 determines the energization time of the heater elements 10*a* based on whether the print data satisfy a given condition determined based on a sensor signal output by the sensor 26. Here, the given condition is a condition regarding the print data and a condition under which the ink ribbon R is damaged to the extent of causing a problem with printing if printing is performed according to print data satisfying the condition. Specifically, for example, the condition is that the number of heater elements energized for printing one line based on the print data (hereafter termed the energized heater elements in the sense of heater elements to be energized) among the heater elements 10*a* has reached a set value set according to the width of the ink ribbon R detected by the sensor 26. When determined that the given condition is satisfied, in other words when determined that the number of energized heater elements has reached a set value, the controller 5 may calculate, based on an energization time of the heater elements 10*a* determined regardless of print data (a first energization time), an energization time different from that energization time (a second energization time) and may control the energization of the heater elements 10*a* according to the calculated energization time.

As described above, the controller 5 determines the energization time based on a condition regarding the print data, whereby the printing device 1 can reduce damage to the ink ribbon R so as to cause no problem with printing.

Figure 7:
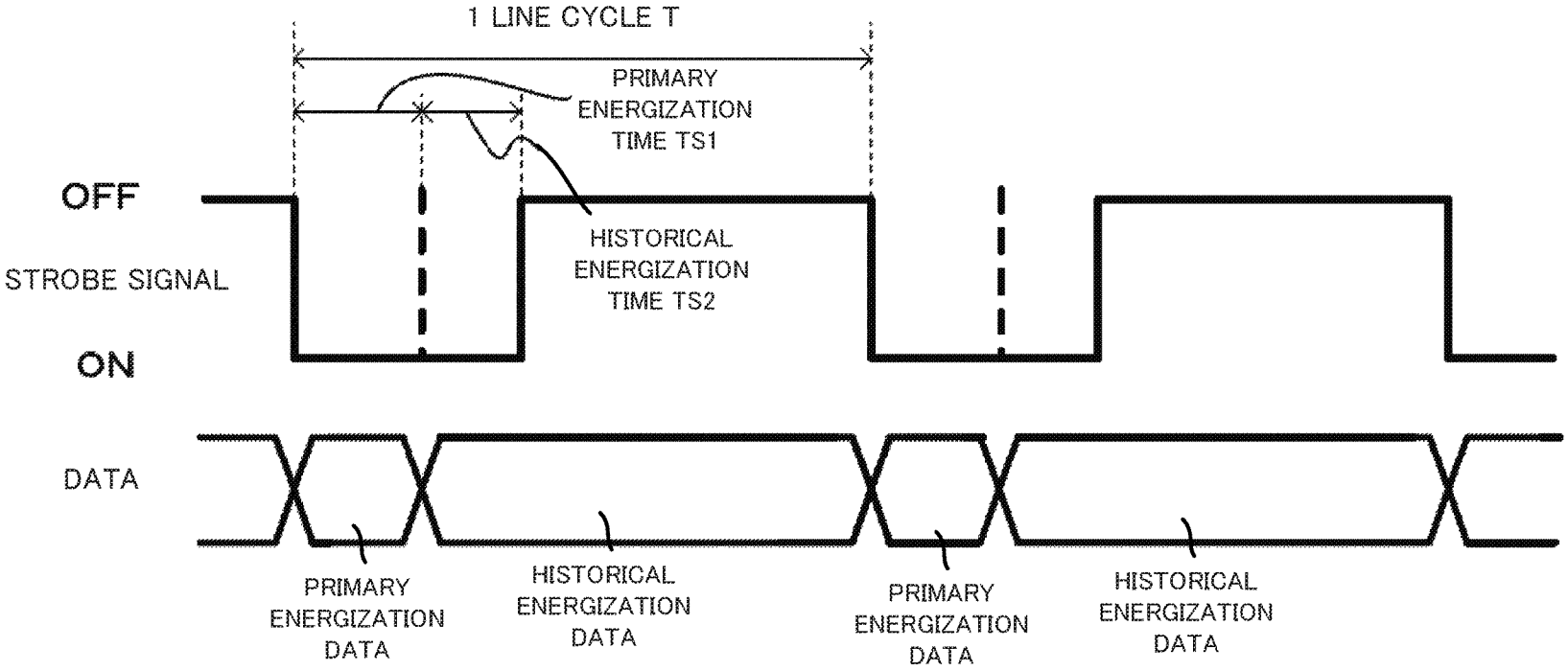
FIG. 7 is an exemplary timing chart of the signal output by the controller of the printing device according to Embodiment 1 of the present disclosure.

Moreover, for controlling the print density, the controller 5 of the printing device 1 changes print data one time during an energization time period in which the thermal head 10 prints one line. Specifically, for example as shown in FIG. 7, the controller 5 may change print data retained by the head drive circuit 9 during an energization time period from primary energization data (first energization data) to historical energization data (second energization data). Here, the primary energization data are print data presenting a print pattern to be formed on a line to print during that energization time period (hereafter termed the target line). A primary energization time TS1 shown in FIG. 7 indicates the span of a time period in which the energization is controlled according to primary energization data. In other words, the primary energization time TS1 is the time corresponding to primary energization data in an energization time. Moreover, the historical energization data are print data generated based on the print data of a preceding line that is printed before the target line (for example, the line prior to the target line by one line). A historical energization time TS2 shown in FIG. 7 indicates the span of a time period in which the energization is controlled according to historical energization data. In other words, the historical energization time TS2 is the time corresponding to historical energization data in an energization time. Moreover, a line cycle T shown in FIG. 7 indicates the span of a time period in which the printing medium M is conveyed by one line.

As described above, the printing device 1 can control the print density by changing the print data during an energization time period. As a result, a desired pattern can be printed.

Figure 8:
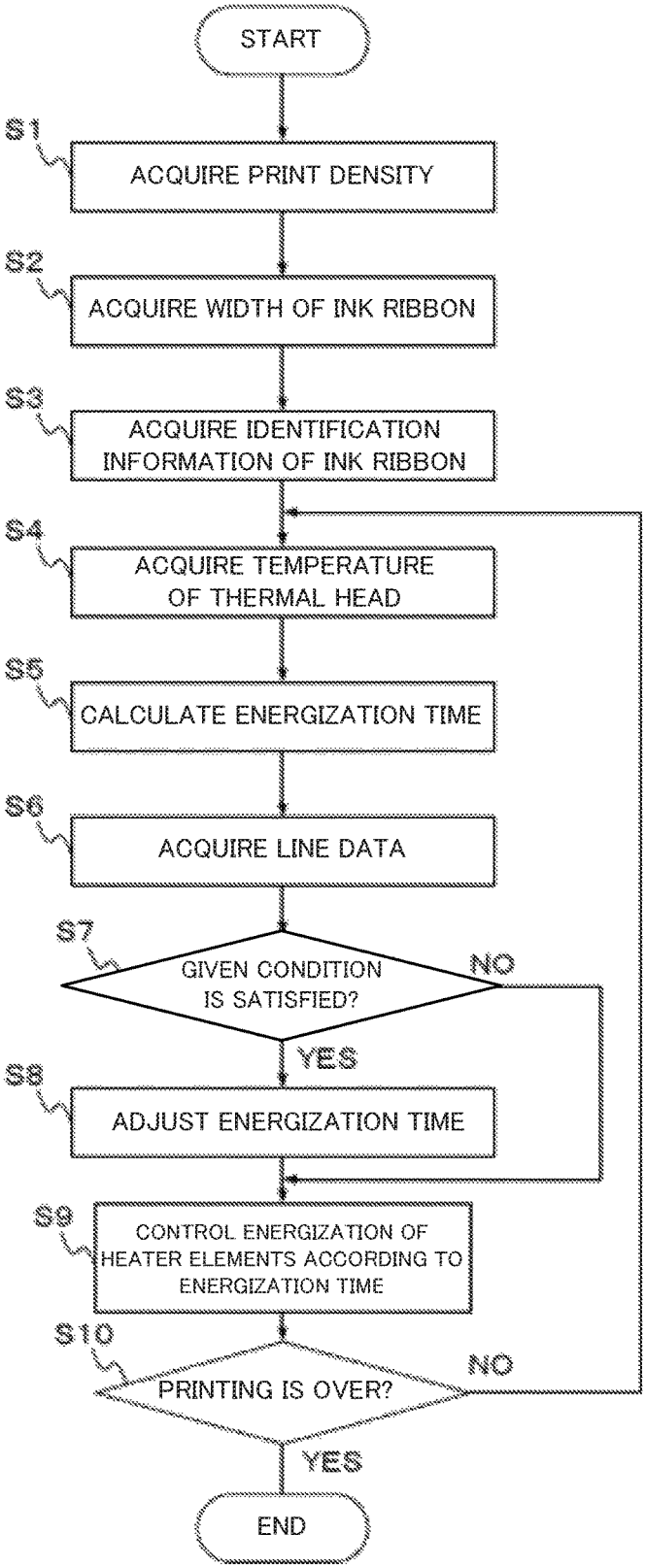
FIG. 8 is a flowchart showing an example of the print control procedure according to Embodiment 1 of the present disclosure.

FIG. 8 is a flowchart showing an example of the print control procedure. FIGS. 9 to 13 are charts showing examples of the tables saved in the ROM 6. FIG. 9 is a chart showing an example of a density coefficients table T1. FIG. 10 is a chart showing an example of a thresholds table T2 regarding the number of print dots in primary energization. FIG. 11 is a chart showing an example of a thresholds table T3 regarding the number of print dots in historical energization. FIG. 12 is a chart showing an example of a first primary energization time adjustment table T4. FIG. 13 is a chart showing an example of a first historical energization time adjustment table T5. The print control procedure of the printing device 1 performed by the controller 5 executing a print program will be described specifically below with reference to FIGS. 8 to 13.

As the print control procedure shown in FIG. 8 starts, the controller 5 first acquires a print density (Step S1). Here, the controller 5 acquires a print density level (hereafter, the density level) prespecified by the user using the input device 3. Here, the density level (in other words, a print density setting) is acquired to determine the energization time adjustment coefficients according to the density level as described later.

Then, the controller 5 acquires the width of the ink ribbon R based on a sensor signal output by the tape width detection switches 24 (Step S2). Then, the controller 5 acquires identification information (the material, the color, and/or the like) of the printing medium M and the ink ribbon R housed in the tape cassette 30 based on a control signal output by the reader 25 (Step S3).

Furthermore, the controller 5 acquires the temperature of the thermal head 10 (Step S4). Here, the controller 5 acquires the temperature of the thermal head 10 based on a sensor signal output by the thermistor 13.

Subsequently, the controller 5 calculates the energization time (Step S5). Here, the controller 5 searches, for example, an energization times table on which the energization time at each temperature is recorded using the temperature of the thermal head 10 acquired in the Step S4 as the key to acquire an energization time corresponding to the temperature. Here, the energization times table is presaved in the ROM 6. Furthermore, the controller 5 searches the density coefficients table T1 shown in FIG. 9 using the density level acquired in the Step S1 and the width of the ink ribbon R acquired in the Step S2 as the keys to acquire a density coefficient. Finally, the controller 5 multiplies the energization time acquired from the energization times table by the density coefficient acquired from the density coefficients table T1 to calculate an energization time. The calculated energization time is an energization time of the heater elements 10*a* determined regardless of print data and the first energization time of the printing device 1. The first energization time is calculated for each of primary energization and historical energization.

As an energization time is calculated, the controller 5 acquires line data that are print data of a target line (Step S6). Subsequently, the controller 5 determines whether the line data satisfy a given condition (Step S7).

In the Step S7, the controller 5 first searches the thresholds table T2 shown in FIG. 10 using the width of the ink ribbon R acquired in the Step S2 as the key to acquire a threshold of the number of print dots (also called the number of ON dots) in primary energization (in other words, a first set value set according to the width of the ink ribbon). Then, the controller 5 determines whether the number of print dots of primary energization data in the line data acquired in the Step S6 (in other words, the number of energized heater elements specified based on the primary energization data) exceeds the threshold acquired from the thresholds table T2. Here, the number of prints dots is the number of heater elements 10*a* generating heat at a time and the threshold of the number of print dots is the maximum number of print dots that presumably does not damage the ink ribbon R to the extent of causing a problem with printing.

In the Step S7, the controller 5 further searches the thresholds table T3 shown in FIG. 11 using the width of the ink ribbon R acquired in the Step S2 as the key to acquire a threshold of the number of print dots in historical energization (in other words, a second set value set according to the width of the ink ribbon). Then, the controller 5 determines whether the number of print dots of historical energization data in the acquired line data (in other words, the number of energized heater elements specified based on the historical energization data) exceeds the threshold acquired from the thresholds table T3.

Then, if at least one of the number of print dots of primary energization data and the number of print dots of historical energization data exceeds the threshold, the controller 5 determines that a condition under which the ink ribbon R is damaged to the extent of causing a problem with printing (a given condition) is satisfied.

If determined that a given condition is satisfied, the controller 5 adjusts the energization time calculated in the Step S5 (Step S8) and controls the energization of the heater elements 10*a* according to the adjusted energization time (Step S9). On the other hand, if determined that a given condition is not satisfied, the controller 5 controls the energization of the heater elements 10*a* according to the energization time calculated in the Step S5 (Step S9).

In the Step S8, the controller 5 adjusts the primary energization time calculated in the Step S5 if determined in the Step S7 that the number of print dots of primary energization data exceeds the threshold. Moreover, the controller 5 adjusts both the primary energization time and the historical energization time calculated in the Step S5 if determined in the Step S7 that the number of print dots of historical energization data exceeds the threshold.

More specifically, if determined in the Step S7 that the number of print dots of primary energization data exceeds the threshold and the number of print dots of historical energization data does not exceed the threshold, the controller 5 searches the first primary energization time adjustment table T4 shown in FIG. 12 using the density level acquired in the Step S1 and the width of the ink ribbon R acquired in the Step S2 as the keys to acquire a first adjustment coefficient of the primary energization time. Moreover, if determined in the Step S7 that the number of print dots of primary energization data exceeds the threshold and the number of print dots of historical energization data exceeds the threshold, the controller 5 searches the first primary energization time adjustment table T4 shown in FIG. 12 using the density level acquired in the Step S1 and the width of the ink ribbon R acquired in the Step S2 as the keys to acquire a first adjustment coefficient of the primary energization time. Additionally, the controller 5 searches the first historical energization time adjustment table T5 shown in FIG. 13 to acquire a first adjustment coefficient of the historical energization time. Then, the controller 5 multiplies the energization time by the corresponding, acquired adjustment coefficient. In other words, the first adjustment coefficient of the primary energization time is a coefficient to multiply the primary energization time calculated in the Step S5 and the first adjustment coefficient of the historical energization time is a coefficient to multiply the historical energization time calculated in the Step S5.

Here, the coefficients acquired from the energization time adjustment tables are values all lower than 100%. Therefore, the energization time is reduced by multiplying an adjustment coefficient. Moreover, in comparison between the first primary energization time adjustment table T4 and the first historical energization time adjustment table T5, the adjustment coefficients saved in the first historical energization time adjustment table T5 are equal to or lower than the adjustment coefficients saved in the first primary energization time adjustment table T4. This is because the historical energization time is shorter than the primary energization time. Adjusting a shorter historical energization time with a higher rate than adjusting a primary energization time makes it possible to adjust the primary energization time and the historical energization time in a balanced manner so as to prevent damage to the ink ribbon R.

Finally, the controller 5 determines whether the printing is over (Step S10). Then, the controller 5 repeats the processing of the Steps S4 to S10 until it is determined in the Step S10 that the printing is over.

As the print control procedure shown in FIG. 8 is performed, the energization time is reduced when the number of print dots exceeds a threshold. As a result, the printing device 1 can diminish damage to the ink ribbon R so as to cause no problem with printing. Moreover, in the printing device 1, the adjustment coefficients used in adjusting the energization time change according to the printing environment (here, the density level and the width of the ink ribbon). Thus, it is possible to adjust the energization time properly in accordance with the printing environment and prevent deterioration in the print quality due to excessive adjustment in the energization time. Furthermore, in the printing device 1, the thresholds of the number of print dots change according to the printing environment. Thus, it is possible to properly estimate whether the ink ribbon R is damaged to the extent of causing a problem with printing and more reliably diminish damage to the ink ribbon R.

Modified Embodiment

In the Step S7, the controller 5 further determines whether identification information (the material, the color, and/or the like) of the printing medium M and the ink ribbon R acquired in the Step S3 satisfies a second set condition. The second set condition may be, for example, the combination of the printing medium M being "white" and the ink ribbon R being "black" or the like. This is because whether the ink ribbon R is damaged to the extent of causing a problem with printing may be determined by the combination of the material and/or the color of the printing medium M and the ink ribbon R.

In the Step S8, the controller 5 further adjusts the adjusted primary energization time calculated as described above in the Step S8 if determined that the identification information of the printing medium M and the ink ribbon R acquired in the Step S3 satisfies the second set condition. If determined that the information acquired in the Step S3 satisfies the second set condition, the controller 5 searches a second primary energization time adjustment table T6 shown in FIG. 14 using the density level acquired in the Step S1 and the width of the ink ribbon R acquired in the Step S2 as the keys to acquire a second adjustment coefficient of the primary energization time. Here, at this point, the controller 5 may search a second historical energization time adjustment table T7 shown in FIG. 15 using the density level acquired in the Step S1 and the width of the ink ribbon R acquired in the Step S2 as the keys to further acquire a second adjustment coefficient of the historical energization time. Then, the controller 5 multiplies the energization time by the corresponding, acquired adjustment coefficient to further adjust the energization time. In other words, the second adjustment coefficient of the primary energization time is a coefficient to multiply the adjusted primary energization time calculated in the Step S8 of the above-described embodiment. When the second adjustment coefficient of the historical energization time is further acquired, the controller 5 may multiply the adjusted historical energization time calculated in the Step S8 of the above-described embodiment by the second adjustment coefficient of the historical energization time.

The above-described embodiment and modified embodiment present specific embodiments for easier understanding of the disclosure. The present disclosure is not confined to the above-described embodiment. Various modifications and changes can be made to the printing device, the printing method of the printing device, and the program without departing from the scope of claims.

In the above-described embodiment, a case is described in which the controller 5 changes print data retained in the head drive circuit 9 one time during an energization time period. However, the print data may be changed multiple times. Moreover, the printing device 1 has the input device 3 and the display 4 by way of example. However, the printing device 1 may not have the input device 3 and/or the display 4 and may receive print data from a computer different from the printing device 1. Moreover, the printing device 1 may receive only part of print data from another computer and, for example, may receive primary energization data from another computer and generate historical energization data.

Moreover, in the above-described embodiment, a case is described in which a given condition (a condition under which the ink ribbon R is damaged to the extent of causing a problem with printing) is determined based on the width of the ink ribbon R. However, the given condition may be determined with consideration of the temperature of the thermal head 10. For example, the printing device 1 may use a thresholds table T8 shown in FIG. 16 instead of the thresholds table T2 shown in FIG. 10. In such a case, it is desirable that a relation in which the threshold decreases as the temperature of the thermal head 10 lowers as shown in FIG. 16 is recorded in the thresholds table T7. This is because when the temperature of the thermal head 10 is lower, a longer energization time (the first energization time) is calculated in the Step S5 of FIG. 8, whereby the ink ribbon R is highly likely to be damaged significantly even with a smaller number of print dots.

Moreover, in the above-described embodiment, a case is described in which the controller 5 adjusts the energization time using the adjustment coefficient determined based on the density level and the width of the ink ribbon R. However, the controller 5 may adjust the energization time with consideration of the temperature of the thermal head 10. For example, the controller 5 may use a first primary energization time adjustment table T9 shown in FIG. 17 instead of the first primary energization time adjustment table T4 shown in FIG. 12. In such a case, it is desirable that a relation in which the adjustment coefficient decreases as the temperature of the thermal head 10 lowers as shown in FIG. 17 is recorded in the first primary energization time adjustment table T9. This is because when the temperature of the thermal head 10 is lower, a longer energization time is calculated in the Step S5 of FIG. 8, whereby it is desirable to reduce the energization time to a larger extent. The controller 5 can adjust the energization time more properly with consideration of the temperature of the thermal head 10.

A case is described above in which the threshold and the adjustment coefficient are determined based on at least one of the width of the ink ribbon R and the temperature of the thermal head 10. However, the threshold and the adjustment coefficient may be determined based on a combination of at least one of the above factors and the type of the printing medium M and/or the ink ribbon R. This is because when the ink ribbon R is of a different type, difference in material or the like changes the acceptable energy amount. Moreover, even with the use of the same type of ink ribbon R, it is possible to determine the amount of energy to apply to the ink ribbon R depending on the type of the printing medium M (a magnet, a cloth, and the like). The printing device 1 can identify the type of the ink ribbon R based on a sensor signal output by the reader 25. The printing device 1 can adjust the energization time more properly with consideration of the type of the ink ribbon R.

Moreover, instead of the number of print dots, the ratio of the number of print dots to the total number of dots may be recorded in the thresholds tables as the threshold. Moreover, instead of adjustment coefficients that are multipliers to multiply the energization time, adjustment times [μsec] that are subtrahends to be subtracted from the energization time may be recorded in the energization time adjustment tables.

Moreover, in the above-described embodiment, a case is described in which the printing device 1 adjusts the energization time using the first primary energization time adjustment coefficient, the second primary energization time adjustment coefficient, and the historical energization time adjustment coefficient. It is unnecessary to always use all of these coefficients for adjusting the energization time. For example, the printing device 1 may adjust the energization time using only the first primary energization time adjustment coefficient or may adjust the energization time using the first primary energization time adjustment coefficient and the historical energization time adjustment coefficient.

Moreover, in the above-described embodiment, a case is described in which the printing device 1 adjusts the energization time for reduction. However, the printing device 1 may adjust the energization time for extension. In other words, the printing device 1 may estimate a short energization time for which the ink ribbon R is not damaged to the extent of causing a problem with printing regardless of print data (a first energization time) and then adjust the energization time for extension with consideration of the printing environment and print data.

As described above, the present disclosure can apply various changes or modifications to the above-described specific embodiment and embodiments including such changes or modifications are included in the technical scope of the present disclosure, which is apparent to a person in the field from the description in the scope of claims.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

What is claimed is:

1. A printing device, comprising:

a thermal head comprising heater elements arrayed into a line along an array direction intersecting a conveying direction of a printing medium; and a head controller that causes the thermal head to print on the printing medium by energizing the heater elements based on line print data into which print data is divided along the array direction, wherein the head controller:

acquires a number of the heater elements to energize based on the line print data; and determines an energization time of one or more of the heater elements corresponding to the line print data according to a result of a comparison between the number of the heater elements to energize and a first threshold, and wherein, in a case where a width of an ink ribbon heated by the energization is equal to or wider than a second threshold, the first threshold is set to be a value that is greater than a value that is set for the first threshold when the width of the ink ribbon heated by the energization is narrower than the second threshold.

2. A printing method executed by a printing device, the printing device comprising (i) a thermal head comprising heater elements arrayed into a line along an array direction intersecting a conveying direction of a printing medium, and (ii) a head controller that causes the thermal head to print on the printing medium by energizing the heater elements based on line print data into which print data is divided along the array direction, and the printing method comprising:

acquiring a number of the heater elements to energize based on the line print data; and determining an energization time of one or more of the heater elements corresponding to the line print data according to a result of a comparison between the number of the heater elements to energize and a first threshold, wherein, in a case where a width of an ink ribbon heated by the energization is equal to or wider than a second threshold, the first threshold is set to be a value that is greater than a value that is set for the first threshold when the width of the ink ribbon heated by the energization is narrower than the second threshold.

3. A printing method executed by a printing device, the printing device comprising (i) a thermal head comprising heater elements arrayed into a line along an array direction intersecting a conveying direction of a printing medium, and (ii) a head controller that causes the thermal head to print on the printing medium by energizing the heater elements based on line print data into which print data is divided along the array direction, and the printing method comprising:

acquiring a temperature of the thermal head; and determining an energization time of one or more of the heater elements corresponding to the line print data according to a result of a comparison between the acquired temperature of the thermal head and a first threshold;

wherein, in a case where a width of an ink ribbon heated by the energization is equal to or wider than a second threshold, the first threshold is set to be a value that is greater than a value that is set for the first threshold when the width of the ink ribbon heated by the energization is narrower than the second threshold.

4. A printing method executed by a printing device, the printing device comprising (i) a thermal head comprising heater elements arrayed into a line along an array direction intersecting a conveying direction of a printing medium, and (ii) a head controller that causes the thermal head to print on the printing medium by energizing the heater elements based on line print data into which print data is divided along the array direction, and the printing method comprising:

energizing one or more of the heater elements corresponding to the line print data for a shorter energization time in a case where a state acquired before printing on the printing medium satisfies a first set condition than in a case where the acquired state does not satisfy the first set condition.

5. The printing method according to claim 4, further comprising determining that the first set condition is satisfied and causing the thermal head to print on the printing medium when a number of the heater elements to energize based on the line print data is greater than a number range for which the head controller determines that the first set condition is not satisfied.

6. The printing method according to claim 4, further comprising:

determining that (i) the first set condition is satisfied when a number of the heater elements to energize based on the line print data is greater than a first threshold and (ii) the first set condition is not satisfied when the number of the heater elements to energize based on the line print data is equal to or smaller than the first threshold; and causing the thermal head to print on the printing medium.

7. The printing method according to claim 6, wherein in a case where a width of an ink ribbon heated by the energization is equal to or wider than a second threshold, a value of the first threshold is set to be greater than a value of the first threshold that is set when the width of the ink ribbon heated by the energization is narrower than the second threshold.

8. The printing method according to claim 6, wherein in a case where a temperature of the thermal head is equal to or higher than a second threshold, a value of the first threshold is set to be greater than a value of the first threshold that is set when the temperature of the thermal head is lower than the second threshold.

9. The printing method according to claim 4, further comprising:

changing the line print data to other line print data for a portion of a time period for printing each line print data, and causing the thermal head to print on the printing medium based on the line print data and the other line print data; and energizing one or more of the heater elements corresponding to the other line print data for an energization time shorter than a duration time, when a number of the heater elements to energize based on the other line print data is higher than a number range, with the duration time being a time during which the head controller energizes the one or more of the heater elements corresponding to the other line print data when the number of the heater elements to energize based on the other line print data falls within the number range.

10. The printing method according to claim 9, further comprising:

determining that (i) the first set condition is satisfied when the number of the heater elements to energize based on the other line print data is greater than a first threshold and (ii) the first set condition is not satisfied when the number of the heater elements to energize based on the line print data is equal to or smaller than the first threshold; and causing the thermal head to print on the printing medium.

11. The printing method according to claim 9, further comprising energizing the one or more of the heater elements corresponding to the other line print data for a shorter energization time in a case where the first set condition is satisfied and any one of a material and a color of the printing medium and a material and a color of an ink ribbon heated by the energization satisfies a second set condition than in a case where the first set condition is satisfied and any one of the material and the color of the printing medium and the material and the color of the ink ribbon heated by the energization does not satisfy the second set condition.

12. The printing method according to claim 4, further comprising energizing the one or more of the heater elements corresponding to the line print data for the shorter energization time, in a case where the first set condition is satisfied and any one of a material and a color of the printing medium and a material and a color of an ink ribbon heated by the energization satisfies a second set condition than in a case where the first set condition is satisfied and any one of the material and the color of the printing medium and the material and the color of the ink ribbon heated by the energization does not satisfy the second set condition.

13. The printing method according to claim 4, wherein in a case where the first set condition is satisfied, when a temperature of the thermal head is higher than a reference temperature, a reference time for energizing the heater elements is set to be shorter than the reference time that is set in a case where the temperature of the thermal head is lower than the reference temperature.

14. A nonvolatile computer-readable recording medium on which a program is stored, the program causing a head controller of a printing device to execute processing, the printing device comprising (i) a thermal head comprising heater elements arrayed into a line along an array direction intersecting a conveying direction of a printing medium, and (ii) the head controller that causes the thermal head to print on the printing medium by energizing the heater elements based on line print data into which print data is divided along the array direction, and the processing comprising:

acquiring a number of the heater elements to energize based on the line print data; and determining an energization time of one or more of the heater elements corresponding to the line print data according to a result of a comparison between the acquired number of the heater elements and a first threshold, wherein, in a case where a width of an ink ribbon heated by the energization is equal to or wider than a second threshold, the first threshold is set to be a value that is greater than a value that is set for the first threshold when the width of the ink ribbon heated by the energization is narrower than the second threshold.

* * * * *